United States Patent [19]

Minard et al.

[11] 4,203,642

[45] May 20, 1980

[54] ADJUSTABLE CONNECTOR

[75] Inventors: James V. Minard, Lake St. Louis County; Loeb J. Goldman, St. Louis; Dale R. Foss, St. Charles, all of Mo.

[73] Assignee: The United States of America as represented by the Secretary of the Air Force, Washington, D.C.

[21] Appl. No.: 42,471

[22] Filed: May 25, 1979

[51] Int. Cl.[2] ..... H01R 13/62

[52] U.S. Cl. ..... 339/75 MP; 339/176 MP

[58] Field of Search ..... 339/75 R, 75 MP, 176 MP, 339/75 M, 74 R, 255 P; 324/158 F

[56] References Cited

U.S. PATENT DOCUMENTS

| | | | |
|---|---|---|---|
| 4,068,170 | 1/1978 | Chayka | 339/74 R X |
| 4,069,403 | 1/1978 | Beaudette | 339/75 MP |

*Primary Examiner*—Joseph H. McGlynn
*Assistant Examiner*—John S. Brown
*Attorney, Agent, or Firm*—Joseph E. Rusz; Casimer K. Salys

[57] ABSTRACT

An adjustable cardedge connector for use with two-sided printed circuit (pc) boards, which connector is capable of individual adjustments to align the contacts on each side of the pc board with corresponding connector contacts, and positive actuation to symmetrically clamp the connector onto the pc board with sufficient contact pressure to insure electrical continuity. On either side of a center board structure are pivotally attached clamping arms. At one end both clamping arms are actuated by a symmetrically disposed screw device referenced to the center board and attached to each clamping arm. The opposite ends of the clamping arms have segments which translate parallel to the pivot axis so that the connector contacts can be aligned with the pc board contacts. Attached to each translating segment is a block having multiple electrical contacts. When the connector and board are aligned and the screw device is actuated, the contacts on both blocks are compressively joined to the corresponding contacts on the two sides of the pc board.

4 Claims, 2 Drawing Figures

ADJUSTABLE CONNECTOR

RIGHTS OF THE GOVERNMENT

The invention described herein may be manufactured and used by or for the Government of the United States for all governmental purposes without the payment of any royalty.

BRIEF SUMMARY

The present invention is directed to an adjustable cardedge connector of the type generally used to mate with contacts at the outer edge of a two-sided printed circuit (pc) board. In particular, the connector taught herein has a substantially planar center structure which when mated is aligned with the plane of the pc board. On either side of this center structure are pivotally mounted clamping arms having rows of electrical contacts at the ends closing onto the pc board edge. A symmetrically actuated means for generating the clamping pressure compensates for variations in board thickness and pressure needed to overcome contact surface contaminants.

The segments of the clamping arms on which the electrical contacts are mounted can be individually translated in a direction parallel to the pivoting axis. Thereby, each set of connector clamping arm contacts can be aligned with the corresponding set of pc board contacts.

Prior to installing the connector on the pc board edge, the clamping arms are opened. As the connector and board are mated, the individually adjustable segments of the arms are moved to align the connector contacts with the pc board contacts. Once the connector and board are joined, the actuation means driving the clamping arms is adjusted to create sufficient pressure between sets of contacts for reliable electrical continuity.

DETAILED DESCRIPTION

Figure 1:
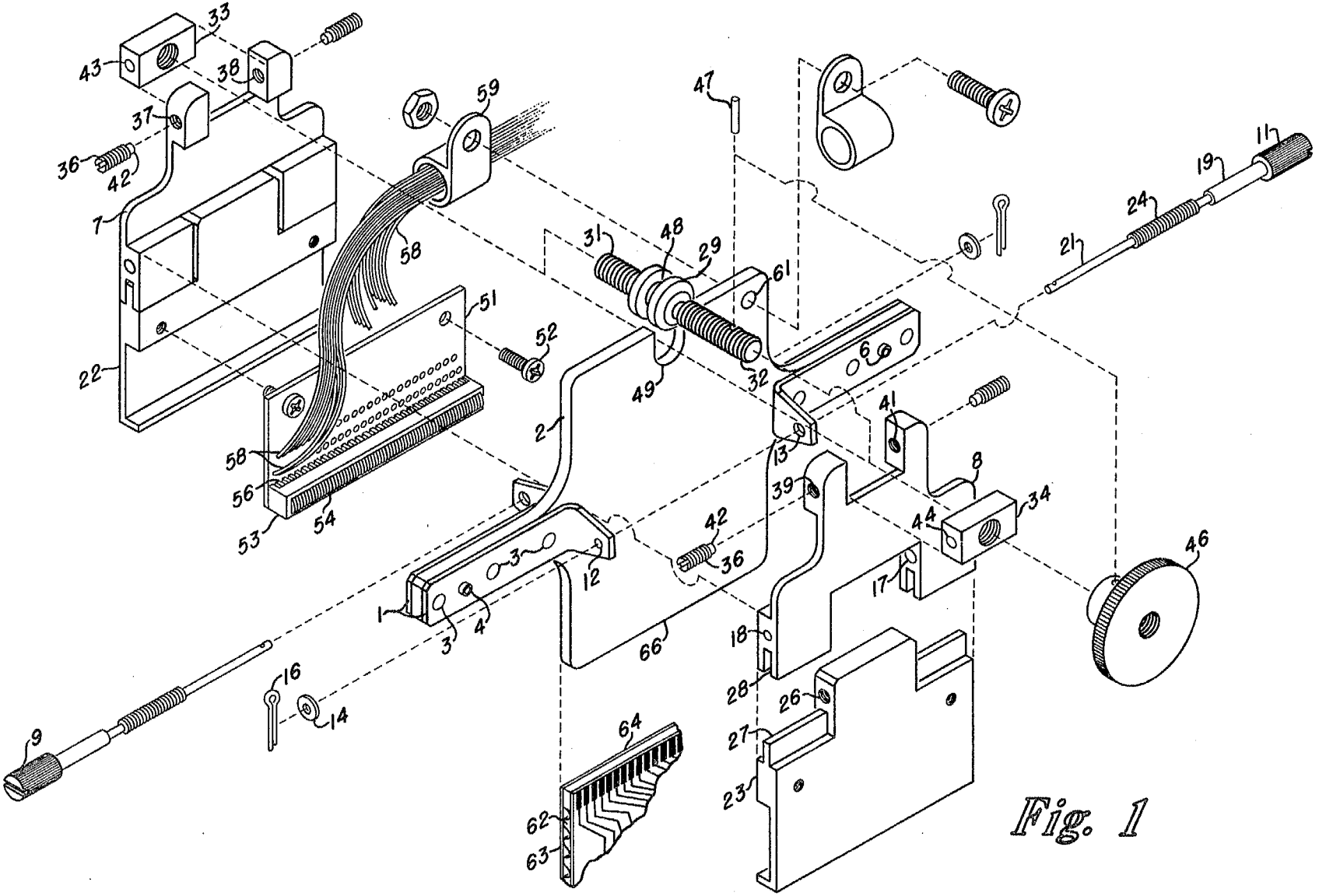
FIG. 1 is an exploded isometric view of the connector apparatus.

Cardedge connectors are, as a general rule, well known by those practicing in the related arts. In one form, such connectors are designed for mating with two-sided printed circuit (pc) boards having aligned sets of contacts. Since the board and board contact thicknesses are also well controlled dimensions, conventional cardedge connectors contain mating contacts having limited expansion range and moderate spring force. In a similar vein, the conventional pc boards used with such connectors are fabricated as a single unit. This construction accurately controls alignment from side to side, or from either side to an indexing system on the board. Thereby, with normal manufacturing tolerances such connectors and boards may be mated interchangeably.

In one aspect the connector disclosed herein is distinguishable from those known in the art by the unique pc boards which it attaches to. It is the peculiarities of the pc boards and cost reduction techniques associated with their fabrication which create the problems addressed by the adjustable connector.

Consider, as a first variant, a connector which is part of a test fixture and is therefore repetitively attached to and removed from pc boards as they are connected for testing. The connector must, nevertheless, reliably join with all the contacts on each pc board. A particularly burdensome aspect of this mating relates to the use of pc board contacts having a solder plate finish as a substitute for the expensive gold plating previously used. Solder plate forms an external coating of nonconductive oxide which must be penetrated to obtain a reliable electrical connection. Penetration is consistent only when the contact pressure imposed is sufficient to cold flow the solder. One skilled in the are recognizes the countervailing effects of increasing spring pressure to aid in the penetration of surface contaminants on a connector which is to be mated and removed frequently, and particularly in the face of the structural limitations noted in the forthcoming paragraphs.

Another consideration relating to the structure of the adjustable connector is directly linked to the sandwiched form of the pc boards used with the adjustable connector. Sandwiching allows the creation of cooling air passage between the board layers. On the other hand, sandwiched or laminated pc board construction does not produce the consistent thickness available in single layer boards, with the thickness tolerance range being sufficient to prevent reliable connection of all contacts when using conventional connectors. The inconsistent contact problem is further exacerbated when solder plate rather than gold plate covers the pc board contacts.

The sandwiched pc board creates still another problem having a direct impact on the connector configuration. With this form of pc board structure, alignment tolerances between contacts on the two sides of the pc board can approach the magnitude of the spacing between adjacent contacts. For example, conventional contacts are spaced at intervals of 2.54 mm for a junction having 100 joints, 50 on either side of the pc board. For the particular embodiment shown the component design permitted only half that spacing. One skilled in the art will recognize that the sandwich pc board construction with the tighter contact spacing is particularly susceptible to such misalignments.

The invention as embodied in the structure shown surmounts the above-described deficiencies of normal connectors, providing the user with an apparatus which fully mates repeatedly to sandwich type pc boards. The connector halves corresponding to the contact faces of the pc board are independently adjustable to permit individual alignment with the pc board contacts or a reference on the pc board. To compensate for variations in board thickness and contact pressure needs, the adjustable connector combines a conventional spring contact structure with a positively actuated screw mechanism for increasing or decreasing contact pressure. Thereby, the likelihood of connector contact or pc board contact damage is reduced without introducing a concomitant decrease in contact pressure. Structurally, the alignment and compression functions are performed by independent mechanisms.

Figure 2:
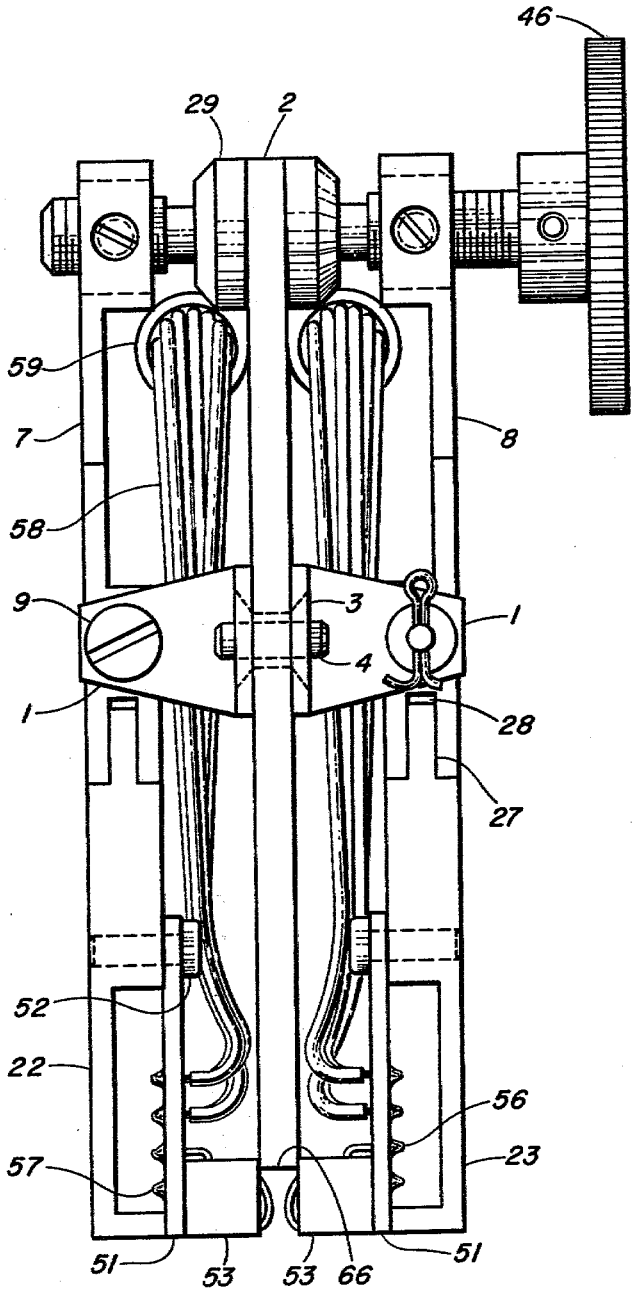
FIG. 2 is an end view of the connector apparatus fully assembled.

Attention is now directed to FIG. 1 where the embodiment is isometrically shown in an exploded form. In FIG. 2 the assembled connector is shown as viewed from one end. Steel angles 1 are attached to the longitudinally extending arms of plastic board 2 using flush rivets 3. Reference pins 4 and 6 protrude on either side of the riveted arms sufficiently to engage an aligning fixture used with this adjustable connector embodiment. Adjacent both faces of plastic board 2 are pivotally mounted upper plates 7 and 8. The plates are mounted between steel angles 1 with screws 9 and 11, which screws themselves are retained in place by washers 14 and cotter pins 16. In the case of upper plate 8, hole 17 is larger than hole 18, as are corresponding steel angle holes 13 and 12, to accommodate the variations in diameter between segments 19 and 21 of screw 11. Upper plate 7 is identically mounted. Lower plates 22 and 23 are also held in position by respective screws 9 and 11. Screw threads 24 engage hole threads 26 to generate back and forth translation of lower plate 23. Lower plate 22 is similarly moved. The upper and lower plates fit together using tongue-and-groove joint 27 and 28, which further restrains all movement except translation in their common plane responsive to screw 11 rotation.

The upper ends of upper plates 7 and 8 are joined by shaft 29. The shaft has oppositely threaded ends 31 and 32 to engage corresponding nuts 33 and 34, which nuts are themselves pivotally mounted in the upper plates using set screws 36. These set screws protrude inwardly through threaded holes 37, 38, 39 and 41 so that set screw shafts 42 enter holes 43 and 44 in the two nuts. Shaft 29 is manually rotated using knob 46 fixed to the shaft by set screw 47. When fully assembled, channel 48 of shaft 29 fits into recess 49 in plastic board 2. Thereby, symmetry is maintained about plastic board 2 whenever the plate assemblies are pivoted like clamping arms about their mounting hinges.

Circuit board 51 is mounted to each of the lower plates using screw 52. For clarity, only one appears in FIG. 1. Both lower plates 22 and 23 are recessed in the region directly behind their boards to avoid electrical contact between the electrically conductive plates and the contacts on circuit boards. Mounted on each of the two boards are contact blocks 53, each block having a quantity of 50 spring contacts 54. Each block is fixed to its respective board by solder joints between pin ends 56 and 57 and the electrically conductive runs on the opposite side of the boards. To provide strain relief for wires 58, the group of wires from each board is held by one of two clamps 59. The clamps themselves are attached by a screw through hole 61 in the upper region of plastic board 2.

Below the connector in FIG. 1, a segment of sandwiched pc board is depicted. Readily visible are cooling air passage 62 and joint 63 of the sandwiched structure. When the connector and sandwiched pc board are fully mated, upper edge 64 of the pc board abuts lower edge 66 of plastic board 2.

During normal use the adjustable connector is mounted in an aligning and support bracket and located by means of reference pins 4 and 6. Knob 46 is rotated until spring contacts 54 are near the sandwiched pc board. Spring contacts 54 are then visually aligned with the contacts on the pc board as the units are mated. Each side is individually adjusted using either screw 9 or 11. Once the adjustable connector and the pc board are aligned and engaged to abutment, knob 46 is rotated to clamp the pc board with sufficient pressure to penetrate contaminants and insure electrical continuity. To disengage the adjustable connector, the clamping pressure is released and the connector is separated from the pc board.

I claim:

1. An adjustable cardedge connector for use with two-sided pc boards, comprising:

a. a center structure, lying substantially coplanar with the pc board after mating;

b. two clamping arms, one each pivotally attached on either side of said center structure;

c. an actuation means for moving said arms, referenced to said center structure and extending laterally therefrom to attachments with each of said clamping arms;

d. a means for individually translating a segment of each clamping arm parallel to the clamping arm pivot axis; and e. inwardly directed electrical contact means on the clamping arms for making contact between the connector and the pc board when said arms are actuated to compress the pc board therebetween.

2. The connector as recited in claim 1, wherein the inwardly directed electrical contact means comprises a pair of substantially juxtaposed contact blocks each containing multiple spring contacts.

3. The connector as recited in claim 2, wherein said actuation means for moving said clamping arms comprises a screw operated mechanism in the form of a shaft extending either direction of the center structure, having threads of opposite direction on each shaft extension.

4. The connectors as recited in claims 1, 2 or 3, wherein the means for individually translating a segment of each clamping arm comprises clamping arm pivotal shafts having threaded portions which engage the arm segments and translate in response to rotations of said pivotal shafts.

* * * * *